United States Patent [19]

Blangetti et al.

[11] Patent Number: 5,018,572

[45] Date of Patent: May 28, 1991

[54] STEAM CONDENSER

[75] Inventors: Francisco Blangetti; Vaclan Svoboda, both of Baden, Switzerland

[73] Assignee: Asea Brown Boveri Ltd., Baden, Switzerland

[21] Appl. No.: 481,205

[22] Filed: Feb. 20, 1990

[30] Foreign Application Priority Data

Feb. 23, 1989 [CH] Switzerland ..... 670/89

[51] Int. Cl.[5] ..... F28B 9/10

[52] U.S. Cl. ..... 165/113; 165/114; 60/292

[58] Field of Search ..... 165/113, 114; 60/292

[56] References Cited

U.S. PATENT DOCUMENTS

| | | | |
|---|---|---|---|
| 1,578,031 | 3/1926 | Hodgkinson | 165/114 |
| 1,812,591 | 6/1931 | Grace | 165/114 |
| 2,848,197 | 8/1958 | Evans, Jr. et al. | 165/114 |
| 2,869,833 | 1/1959 | Aronson et al. | 165/113 |
| 2,939,685 | 6/1960 | Worn et al. | 165/114 |

FOREIGN PATENT DOCUMENTS

| | | |
|---|---|---|
| 1501339 | 12/1969 | Fed. Rep. of Germany . |
| 423819 | 5/1967 | Switzerland . |

*Primary Examiner*—Albert W. Davis, Jr.
*Attorney, Agent, or Firm*—Oblon, Spivak, McClelland, Maier & Neustadt

[57] ABSTRACT

In a steam condenser erected on-floor, in which the steam is precipitated on pipes through which cooling water flows and which are combined into separate clusters (2), the pipes of a cluster, which are arranged in rows, enclosing a cavity (13), a cooler (14) for the non-condensable gases is arranged in the cavity. The component clusters (2) are aligned horizontally in their longitudinal extent and are arranged vertically above one another. The cooler (14) for the non-condensable gases has its suction effect directed towards a zone below the longitudinal center line of the individual cluster.

3 Claims, 2 Drawing Sheets

STEAM CONDENSER

BACKGROUND OF THE INVENTION

1. Field of the Invention

The invention concerns a steam condenser for on-floor arrangement with a steam turbine, the steam being precipitated on pipes through which cooling water flows and which are combined into separate component clusters, and the pipes of a cluster, which are arranged in rows, enclosing a cavity in which a cooler for the non-condensable gases is arranged.

2. Discussion of Background

Swiss Patent No. 423,819 discloses such a steam condenser, although for the so-called underfloor arrangement. There, the condenser pipes are arranged in a condenser housing in a plurality of so-called component clusters. The steam flows through an exhaust steam nozzle into the condenser housing, and it is distributed in the space by flow channels. These contract in the general direction of the flow in such a way that the flow velocity of the steam in these channels remains at least approximately constant. The free flow of the steam into the external pipes of the component cluster is preserved. The steam subsequently flows through the clusters with low resistance caused by the shallow pipe row depth. In order to be able to fulfill the condition of holding constant the steam velocity in the inflow channels, the component clusters in the condenser are arranged next to one another in such a way that the flow channels are created between them which appear in sectional view with the same order of magnitude as the component clusters themselves. Furthermore, the pipes in the sequential rows form a self-closed wall, which is preferably of the same thickness throughout.

This known condenser has the advantage that because of the loose arrangement of the component clusters all peripheral pipes of a component cluster are effectively charged with steam without noticeable pressure loss. On the other hand, the requirement for an at least approximately equal "wall thickness" for the component pipe clusters around the cavity demands a relatively large overall height of the component cluster. The result of this is the outstanding suitability of this component cluster concept for high-capacity condensers, in which a plurality of component clusters are arranged standing next to one another. This known solution is less well suited for steam condensers of power station plants, in which the condenser and the turbine are approximately situated at the sam level of the turbine hall foundation, for example owing to restriction of the overall height. In such cases, the condenser can be arranged coaxial with the turbine shaft or laterally along the turbine. Underfloor arrangements are also not possible in the case of watercraft of low draught which are driven by means of steam turbines.

SUMMARY OF THE INVENTION

Accordingly, one object of this invention is to provide a novel condenser of the type mentioned at the beginning, which, while preserving the known advantages of the component cluster concept, is distinguished in addition by low production costs.

This is achieved according to the invention in that the component clusters are oriented horizontally in their longitudinal extent, in that a plurality of component clusters are arranged vertically above one another, and in that the cooler is constructed asymmetrically inside the component clusters, and in that its intake cross section has a geometrical center below the longitudinal center line of the component clusters.

The advantages of the invention are to be seen in that, owing to the intentionally realized pressure reduction in the passages through which flow occurs at the level of the air cooler, the steam-side pressure drop across the cluster is approximately constant on both sides of the particular cluster, so that a homogeneous pressure gradient results in the direction of the cooler. An effective flushing of the steam through the cluster is achieved with this measure. After passing through the maximum velocity, the steam in the passages experiences a braking as far as zero with pressure recovery at the level of the condensate collection tank. This causes an increase in the saturation temperature of the steam, and thus a degeneration of the condensate supercooling which has taken place and of the oxygen concentration in the condensate. Due to the fact that because of the flow guidance selected the build-up does not take place until the lower cluster end, accumulations of non-condensable gases in the cluster passages themselves are also avoided.

Because of the regenerative character of this type of cluster, and of the purpose of arrangement of the air cooler, a specific condensation power is to be expected which is at least 10% above the model laid down by the "Heat Exchanger Institute Standards".

Moreover, further advantages are to be seen in the simple and rapid production of the foundation and in the short commissioning times. In particular, the possibility exists of renouncing the previous expansion elements and connecting the condenser directly to the exhaust steam housing of the turbine, and supporting it with simple sliding shoes.

It is expedient if the pipes of the cooler are provided in the cavity of the cluster with a cover plate, which is, moreover, constructed as a closed exhaust channel, which communicates with the cooler zone via diaphragms. In this regard, the multifunctional cover plate protects the cooler tubes from the condensate running down.

For extraction from the condenser, it is advantageous for the steam/air mixture flowing into the suction channel from the cooler to be exhausted from the channel via at least one suction line penetrating each cluster, for which purpose one or two pipe rows are missing at the surface of discontinuity between the two flows in the otherwise closed shell, and are replaced by blind pipes. These blind pipes, which act as steam locks, prevent a direct flow of the steam into the air coolers.

It is true that a similar screening is already known from the abovementioned Swiss Patent 423,819. However, it is a matter there of a closed casing, which represents an obstacle to flow in the vertical, especially for the down-dropping condensate.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein an illustrative embodiment of the invention is represented diagrammatically with reference to a power station condenser, and wherein.

Figure 1:
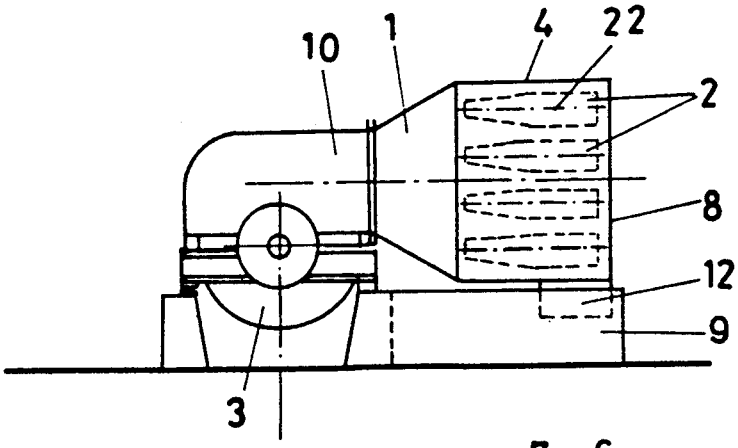
FIGS. 1 and 2 show a sketched front view and top view of a low-pressure turbine together with condenser.

The heat exchanger represented is a surface condenser of rectangular design such as is suitable for the so-called on-floor arrangement. As a rule, such condensers have sensible power ranges of <300 MWe.

DESCRIPTION OF THE PREFERRED EMBODIMENTS

Referring now to the drawings, wherein like reference numerals designate identical or corresponding parts throughout the several views, the steam flows into the condenser throat 1 via an exhaust steam nozzle 10, with which the condenser is connected to the turbine 3. A flow field which is as good and homogeneous as possible is generated therein in order to effect a clean steam washing over their entire length of the clusters 2 arranged downstream.

Figure 2:
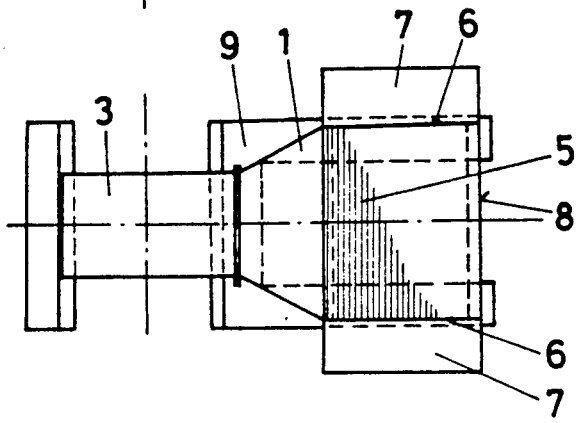

The condensation chamber in the interior of the condenser shell contains four separate clusters 2. The purpose of this is, inter alia, that even during plant operation it is possible to effect partial shutdown on the cooling water side, for example in order to inspect the shutdown cluster on the cooling water side. The independent application of cooling water is manifested by the fact that the water chambers 7 (FIG. 2) are subdivided into compartments by horizontal partition walls (not shown).

The clusters consist of a number of pipes 5, which are fixed at their two ends, in each case, in pipe plates 6. The water chambers 7 are arranged beyond the pipe plates in each case. The condensate flowing off from the clusters 2 is collected in the condensate collection tank 12, and passes from there into the water/ steam circulation (not represented).

Figure 3:
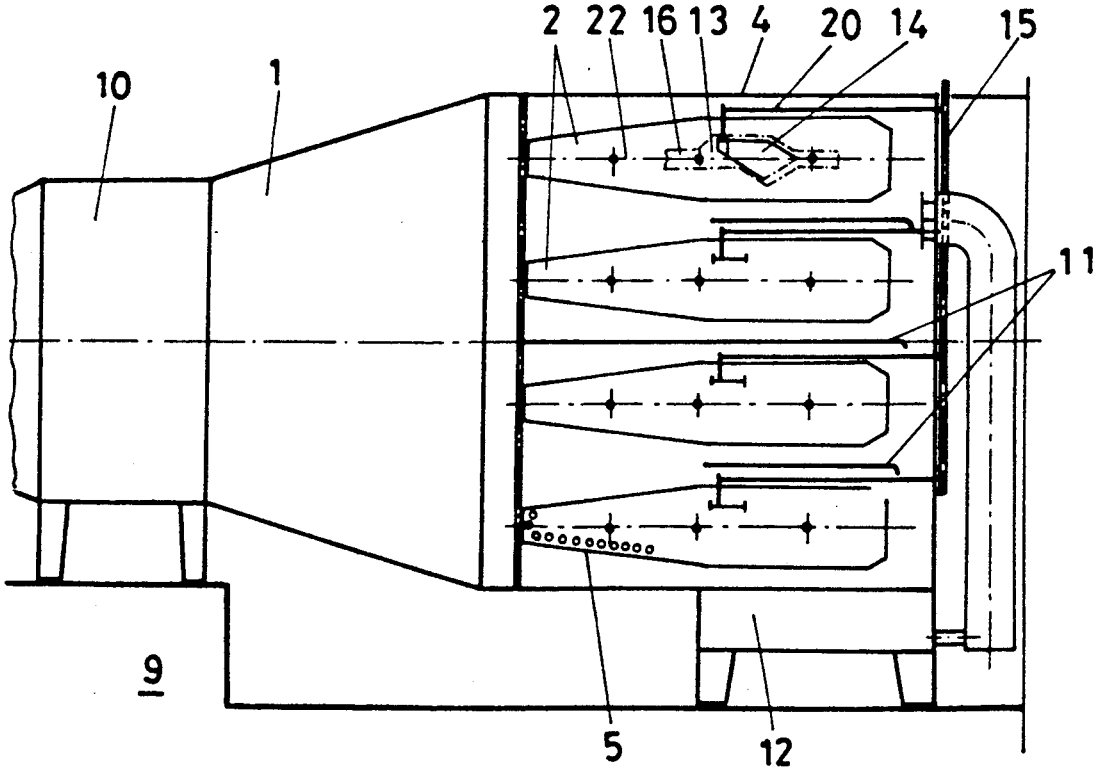
FIG. 3 shows a cross section through the condenser.

In accordance with FIG. 3, a cavity 13, in which the steam enriched with non-condensable gases—termed air below—is collected, is constructed in the interior of each cluster 2. An air cooler 14 is accommodated in this cavity 13. The steam/air mixture flows through this air cooler, the majority of the steam condensing. The rest of the mixture is exhausted at the cold end.

Apart from the horizontal alignment, component cluster condensers are known to this extent. It is to be borne in mind in this regard that the air cooler situated in the interior of the pipe cluster has the effect that the steam/gas mixture is accelerated inside the condenser cluster. There is a consequent improvement in the relationships to the extent that low flow velocities which could impair the heat transfer do not prevail.

Starting from the predetermined external form of the condenser—a cuboid condenser shell in the present case—the form of four clusters 2 is matched so that the following aims are achieved:

- Good exploitation of the temperature variant
- Small pressure drop in the pipe cluster despite high packing density of the piping
- No stagnating accumulations of air in the steam passages and in the clusters
- No supercooling of the condensate
- Good degassing of the condensate.

For this purpose, the clusters are configured in such a way that there is a good supply of steam to all pipes of the periphery without noticeable pressure loss. In order to guarantee a homogeneous, clean steam flow, and especially to exclude accumulations inside the cluster, the existing flow paths between the four clusters 2, on the one hand, and between the outer clusters and the neighbouring condenser wall are constructed as follows:

Firstly, it is assumed that a fairly homogeneous flow field prevails over the entire outflow cross section of the condenser throat 1. The predominant first part of the flow path between cluster start and cluster end is constructed convergently. The flowing steam experiences therein a spatial acceleration with corresponding reduction of the static pressure. This proceeds approximately homogeneously on both sides of the clusters. In connection with the channel contraction to be effected on both sides of the clusters, account must be taken of the fact that the steam mass flow becomes increasingly smaller owing to the condensation.

Upon reaching the maximum predetermined velocity, the steam is now braked as far as zero velocity, with simultaneous pressure recovery. This is achieved in that the second part of the flow path is embodied divergently. Here, too, it is to be borne in mind that, owing to the increasing lessening of the mass flow, the channel expansion need not be optically recognizable. It is decisive that the residual steam flowing to the condenser end 8 generates a stagnation pressure there. Consequently, the steam is deflected, and thus also supplies the lower parts of the clusters. The temperature increase caused by the stagnation pressure benefits the condensate flowing down from pipe to pipe in that the condensate is reheated if it had cooled below saturation temperature. Two advantages are secured in this way: thermodynamic losses due to condensate supercooling do not occur, and the oxygen content of the condensate is reduced to a minimum.

As a further measure which serves the uniform application of steam to the clusters, the air cooler 14 is arranged in the cluster interior at that level at which the pressure variation in the gases flowing through passes through a relative minimum on both sides of the clusters. In the example indicated, the air cooler is therefore situated in the rear half of the component clusters. The cluster is configured in such a way that—taking account of the effective pressure at the pipe periphery, and on the basis of the differing pipe row thickness—the intake of steam into the cavity 13 acts homogeneously in the radial direction over all neighboring pipes in the cavity 13. The result is a homogeneous pressure gradient, and thus a unique direction of flow of the steam and of the non-condensable gases in the direction of the air cooler 14. The cavity 13 opens upstream into a compensation passage 16 inside the cluster, which ensures that even the steam enriched with air finds a frictionless way from the core of the front half of the cluster to the air cooler.

In operation, the steam condenses on the pipes 5, and the condensate drips down against condensate collection plates 11. This dripping down takes place inside the clusters, the condensate coming into contact with steam of rising pressure. These plates 11 are provided in order to avoid the influence of the down-flowing condensate on the clusters located therebelow. Between the uppermost and the second uppermost, and between the lowermost and the second lowermost clusters, these plates reach from the plane of the air cooler 14 as far as the region of the condenser end 8. The plate 11 extends between the central clusters as far as the upper edge of the clusters. The basis for the economic use of condensate collection plates is that the latter simultaneously cause a braking of the steam flow in the steam supply passage and thereby prevent the pressure regeneration. The plates cover the clusters, but in each case leave enough free room for pressure compensation and to render impossible the regeneration of pressure by accumulation of the residual steam velocity at the end of the condensation section, i.e. in the region of the condenser end 8. The resulting steam cushion causes the degeneration of any condensate supercooling, and the final degassing of the finely dispersed condensate at this location.

The entire structural unit of condenser shell, i.e. housing, and component clusters and condensate collection plates is slightly inclined about the turbine axis 24 in the longitudinal pipe direction, in order to encourage the condensate to flow off rapidly.

Figure 4:
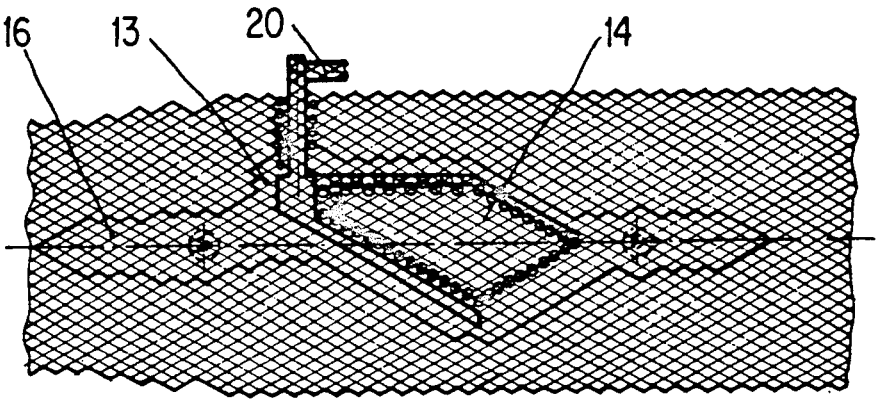
FIG. 4 shows a cross section through a component cluster.
Figure 5:
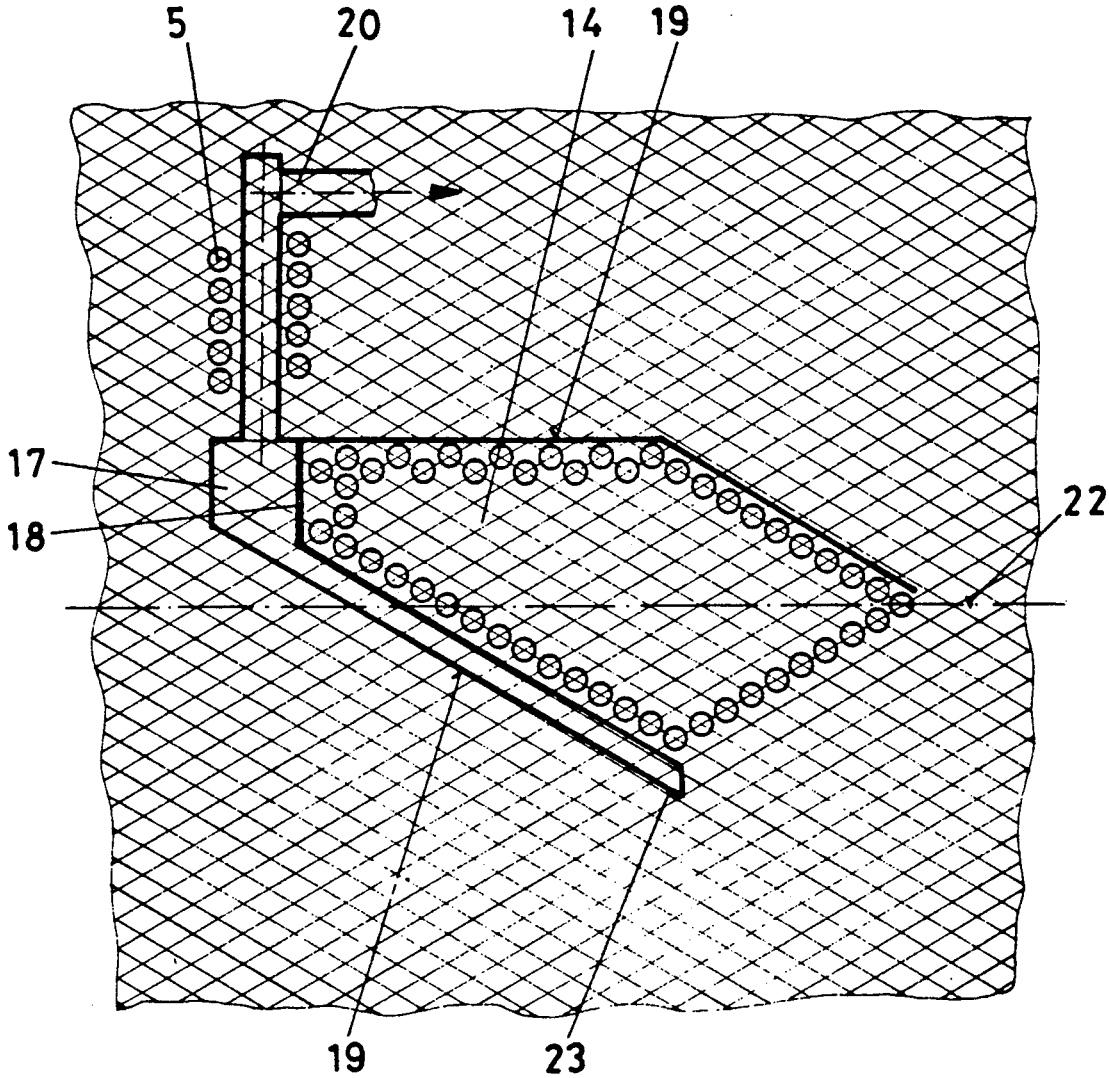
FIG. 5 shows a cross section through a cooler.

As may be seen in particular from FIGS. 4 and 5, the air coolers are of asymmetric form inside the component clusters, and are eccentric in position inside the cavity 13. That is to say, by contrast with the underfloor arrangement of the condenser already mentioned, the clusters 2 are strongly asymmetrically loaded in the case of horizontal erection, since the force of gravity and the force of inertia of the steam velocity are directed virtually perpendicular to one another. However, this asymmetry relates chiefly to the condensate loading in the cluster, and in relation to the geometric cluster contours this leads to a likewise asymmetrical localization of the pressure minimum in the pipe assemblage.

The position of the minimum pressure dictates the position of the air cooler, since the latter is the location of the accumulation of the non-condensable gases. The condensate raining down from above intensifies the steam-side pressure loss in the lower cluster half, and thus causes the downward displacement of the pressure minimum. The air cooler is therefore configured and arranged in such a way as to take account of the above-mentioned asymmetry. The intake of the air takes place owing to the selected cooler configuration below the longitudinal centre line 22 of the cluster.

It is the function of the air cooler 14 to remove the non-condensable gases from the condenser. During this process, the steam losses are to be kept as slight as possible. This is achieved in that the steam/air mixture is accelerated in the direction of the exhaust channel 17. There is a good heat transfer as a result of the high velocity, and this leads to a considerable condensation of the residual steam. In order to accelerate the mixture, the cross section is dimensioned increasingly smaller in the direction of flow, as emerges from FIG. 5. The air is exhausted via diaphragms 18 into the channel 17. These diaphragms, which are provided at the narrowest point of the cooler cover, represent the physical separation of the condensation chamber from the exhaust channel. They are multiply distributed over the entire pipe length and owing to the generation of a pressure loss they cause the suction effect to be homogeneous in all compartments of the condenser.

A part of the wall of the exhaust channel 17 is simultaneously designed as a funnel-shaped cover plate 19. This plate is pushed over the pipes of the cooler, and protects the latter from the flow of steam and condensate traveling from above to below. The direction of entry of the mixture which is to be cooled is thus also predetermined, that is to say forwards from behind towards the diaphragms 18.

The draining of the exhaust channel 17 is done by means of holes 23 multiply arranged in the longitudinal extent of the channel and at the particular lowest point of the channel.

In order to guide the air from the exhaust channel 17 to the suction apparatus (not represented), an appropriate number of pipes 5 are omitted from the clusters 2. Depending upon the size and graduation of the pipes 5 it is a matter in this regard of the omission of either one or two pipe rows. The plurality of suction lines 20 penetrating the cluster upwards are led out through this recess. These suction lines are led parallel to the cluster up to the condenser end 8, where they open into a collecting line 15 leading to the suction apparatus.

The free space resulting from the omission of the pipes is equipped with steam locks. The primary aim of the latter is to prevent a steam bypass. In the present case it is a matter of blind pipes, which do not prevent the vertical exchange of steam or condensate. They form in the direction steam passage/cooler an obstacle to flow which should have the same pressure loss as the original piping. In addition, these blind pipes can also be used as support anchor between the pipe support plates (not shown).

The invention is, of course, not limited to the illustrative embodiment shown and described. Thus, instead of the blind pipes, it would equally well be possible, for example, to use longitudinally oriented, staggered, baffle-like plates as steam locks. It would also be possible entirely to do without the steam locks, if the non-condensable gases were led out from the condenser in the longitudinal direction of the pipe, instead of transversely through the clusters. In this case, the exhaust channel or the suction line connected thereto would have to penetrate one of the two pipe plates 6 and the corresponding water chamber 7. Deviating from the described solution, in accordance with which the entire condenser is slightly inclined with respect to the turbine axis, there would also be the possibility of slightly inclining only the condensation collection plate and the suction channel with the aim of draining off condensate. Finally, the condenser can also, of course, be divided in two and arranged on both sides of the turbine. Likewise, it can be erected in the extension of the turbine axis.

Obviously, numerous modifications and variations of the present invention are possible in the light of the above teachings. It is therefore to be understood that within the scope of the appended claims, the invention may be practiced otherwise than as specifically described herein.

LIST OF DESIGNATIONS

1 Condenser throat
2 Component clusters
3 Turbine
4 Condenser shell
5 Pipe
6 Pipe Plate
7 Water chamber
8 Condenser end
9 Foundation
10 Exhaust steam nozzle
11 Condensate collection plate
12 Condensate collection tank
13 Cavity 14 Air cooler
15 Collecting line
16 Compensation passage
17 Suction channel
18 Diaphragm
19 Cover plate
20 Suction line
22 Longitudinal centre line of 2
23 Drainage hole in 17
24 Turbine axis

What is claimed as new and desired to be secured by Letters Patent of the United States is:

1. Steam condenser for on-floor arrangement with a side inlet connected to a steam turbine, the steam being precipitated on pipes through which cooling water flows and which are combined into separate component clusters, and the pipes of a cluster, which are arranged in rows, enclosing a cavity in which a cooler for the non-condensable gases in arranged, wherein the component clusters are oriented horizontally in their longitudinal extent, a plurality of component clusters are vertically arranged above one another, and each cooler is constructed asymmetrically inside one of the component clusters, wherein an intake cross section of the cooler has a geometrical center below the longitudinal center line of the respective component cluster.

2. The steam condenser as claimed in claim 1, wherein the pipes of the cooler are provided in the cavity of the cluster with a cover plate, which is constructed as a closed suction channel, the latter communicating with the coldest cooler zone via diaphragms.

3. The steam condenser as claimed in claim 1, wherein between two component clusters a horizontally aligned condensate collection plate is arranged in each case, which extends at least from the plane of the cooler as far as the region of the condenser end.

* * * * *